US012759785B2

(12) United States Patent
McDermott

(10) Patent No.: US 12,759,785 B2
(45) Date of Patent: Oct. 13, 2026

(54) CONVERTIBLE SHIPPING CONTAINER

(71) Applicant: INTERMODAL INNOVATIONS LTD, Omagh (GB)

(72) Inventor: Niall McDermott, Omagh (GB)

(73) Assignee: Intermodal Innovations Ltd, Omagh (GB)

( * ) Notice: Subject to any disclaimer, the term of this patent is extended or adjusted under 35 U.S.C. 154(b) by 37 days.

(21) Appl. No.: 18/756,688

(22) Filed: Jun. 27, 2024

(65) Prior Publication Data

US 2025/0019152 A1 Jan. 16, 2025

(30) Foreign Application Priority Data

Jul. 14, 2023 (GB) ..... 2310870
Sep. 26, 2023 (CN) ..... 202311248610.9

(51) Int. Cl.
*B65D 88/12* (2006.01)
*B65D 88/00* (2006.01)

(52) U.S. Cl.
CPC ..... *B65D 88/121* (2013.01); *B65D 88/005* (2013.01); *B65D 2590/0041* (2013.01); *B65D 2590/04* (2013.01)

(58) Field of Classification Search
CPC .. B65D 88/121; B65D 88/0045; B65D 88/12; B65D 2590/0041; B65D 2590/04; B65D 90/02
USPC ..... 220/1.5
See application file for complete search history.

(56) References Cited

U.S. PATENT DOCUMENTS 7,966,775 B2 * 6/2011 Medley ..... E04B 1/3444 52/79.5
2006/0061136 A1 * 3/2006 Pines ..... B62D 33/04 296/186.1
2020/0009824 A1 * 1/2020 Fenton ..... B29C 51/08

FOREIGN PATENT DOCUMENTS

CA 2972169 * 5/2018 ..... B65D 90/02
CA 2972169 A1 5/2018

OTHER PUBLICATIONS

Search and Examination Report for Application No. GB2310870.7, mailed on Dec. 12, 2023, 6 pages.
Email from Bairavi Sanjeevi, with attachment, dated Mar. 14, 2025.

* cited by examiner

*Primary Examiner* — Jeffrey R Allen
*Assistant Examiner* — Elizabeth J Volz
(74) *Attorney, Agent, or Firm* — Sheppard Mullin Richter & Hampton LLP

(57) ABSTRACT

A container is suitable for intermodal freight transport and further suitable for conversion for use other than intermodal freight transport. The container includes walls. At least one of the walls includes an outer skin and an inner skin. The inner skin includes a plurality of parallel vertical strut channels.

16 Claims, 10 Drawing Sheets

CONVERTIBLE SHIPPING CONTAINER

CROSS-REFERENCE TO RELATED APPLICATIONS

This application is based on and claims priority to and benefits of British patent application No. GB 2310870.7 filed on Jul. 14, 2023, and Chinese patent application No. CN 202311248610.9 filed on Sep. 26, 2023. The entire content of all of the above-referenced applications is incorporated herein by reference.

FIELD OF THE INVENTION

The invention relates to intermodal shipping containers, and more specifically to shipping containers suitable for conversion for other purposes than shipping.

BACKGROUND

The majority of intermodal shipping containers are originally manufactured in eastern Asia (e.g., China) where a large proportion of common consumer goods are made and then exported to western markets (e.g., USA) where there is a high demand for such products. Due to a west-east trade imbalance, there are not as many consumer products being made in western countries to be shipped back east. Therefore, most standard general purpose shipping containers are either (a) transported back to the east empty or (b) just resold locally for alternative purposes (e.g., storage, conversion, etc.).

Transporting empty shipping containers from west to east incurs fuel, time, and labour costs for vessel owners. In times of high demand and/or tight schedule, many freight vessels do not backload empty containers in the west and just travel back to the east to collect brand new containers with new cargo.

Reselling of empty shipping containers in the west for alternative purposes (e.g., storage, conversion, etc.) has had limited success because the original container dimensions do not suit the needs of all storage purposes and the original functional design of the containers (for cargo carrying purposes) does not facilitate efficient conversion into building units. Local new build modular construction methods are normally more cost effective for the latter.

STATEMENT OF INVENTION

According to a first aspect of the invention, there is provided a container suitable for intermodal freight transport and further suitable for conversion for other use than intermodal freight transport, the container comprising: walls, at least one of the walls comprising an outer skin; an inner skin, wherein the inner skin comprises a plurality of parallel vertical strut channels.

The inner skin may comprise a plurality of recesses, and the plurality of strut channels may be received in the recesses. In an embodiment, the plurality of strut channels may be connected to each other by a plurality of panels. In an embodiment, the plurality of strut channels may be formed as part of the internal skin panels.

The plurality of strut channels may be spaced apart from each other by a distance of substantially 300 mm.

The strut channels may be received within the inner skin of the container wall such that the main surface of the inner skin is flush.

The strut channels may be suitable for positioning, attaching, and securing of prefabricated structures, furniture, and modules. The strut channels may further be suitable for the routing of mechanical and/or electrical services.

The strut channels may be arranged to receive fixings, channel nuts, cantilever arms or pipe clamps.

The strut channels may be plain channels or slotted channels.

The outer skin and the inner skin of the container walls may define a cavity. The cavity may comprise an insulating material, and the insulating material may comprise polyurethane foam.

The container may comprise an insulating layer in the floor, roof, walls, and external doors.

The container may further comprise double external doors at two opposite ends of the container, and the two ends are optionally the short ends.

One or more of: the inner skin, the outer skin, and the strut channels comprise a metal, optionally stainless steel, further optionally aluminium or aluminium alloy.

According to a second aspect of the invention, there is provided an assembly comprising the container according to the first aspect, and one or more panels arranged to replace external doors when converting the container for other use than intermodal freight transport.

The one or more panels may comprise one or more of: a door, a window and surface decoration.

According to a third aspect of the invention, there is provided a method of manufacturing the container of any one of the preceding claims, the method comprising: forming said outer skin, and forming said inner skin comprising the plurality of parallel vertical strut channels.

Forming said inner skin may comprise rolling or extruding a single portion of aluminium or aluminium alloy into the inner skin comprising the plurality of vertical strut channels and a plurality of panels connecting the plurality of vertical strut channels.

BRIEF DESCRIPTION OF DRAWINGS

Some embodiments of the invention will now be described by way of example only and with reference to the accompanying drawings, in which.

SPECIFIC DESCRIPTION

Herein presented is a container incorporating features at an initial design and manufacture stage of the container which facilitate the conversion of shipping containers into new building units, such as site offices, welfare blocks, and accommodation.

Shipping containers are primarily designed and fabricated for the shipment of goods and therefore their dimensions and capacities are inherently relevant to movement of large volumes of cargo. Shipping container specifications such as dimensions, capacity, testing, etc., are regulated by various ISO standards. The majority of shipping containers have a nominal 8 ft (2,438 mm) external width to suit the intermodal transport network, including trucks, ships, trains, etc. The majority of shipping containers are manufactured in nominal 20 ft (6,058 mm) and 40 ft (12,192 mm) external lengths. The majority of 20 ft (6,058 mm) long shipping containers have a nominal 8'6" (2,591 mm) external height, while the majority of 40 ft (12,192 mm) long shipping containers have a nominal 9'6" (2,896 mm) external height. The container presented herein has the same range of external dimensions, such that it complies with the same standards and can be used for transport on the same vessels or vehicles.

An ISO shipping container includes further standard features, such as corner castings at each of the eight corners for hoisting, stacking, and securing by way of twist locks. These features are also part of the container presented herein, and are not described in detail as they will be known, as such, to the skilled person.

A first stage of common shipping container conversion projects normally involves cutting holes in the steel container walls for doors and windows which is expensive, time consuming and counterproductive to the original structure design due to the high strength of the steel material and specialist skills and equipment required to complete the cutting.

The convertible container presented herein, on the other hand, includes external doors at both short ends of the container to provide standard opening sizes for the installation of internal doors and windows to facilitate air, light, and personal access. The external doors at both ends can easily be removed from their hinges and replaced with desired panels or doors, depending on the purpose of the converted container.

Figure 1:
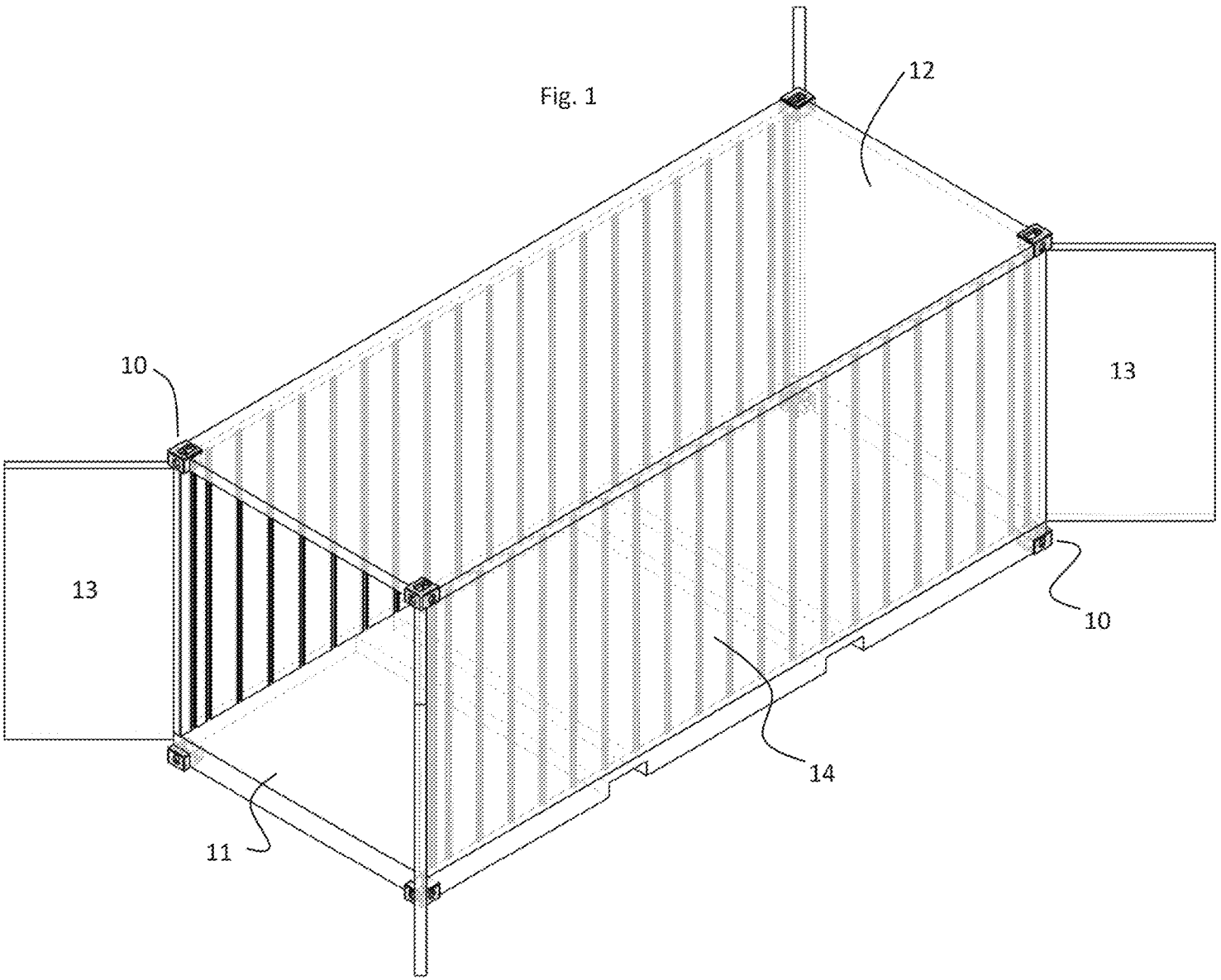
FIG. 1 depicts a simplified isometric view of an insulated strut lined shipping container described in the present disclosure.

FIG. 1 provides a simplified isometric view of the proposed container with all potential panel corrugations and all small parts such as door fittings hidden to allow enhanced viewing of the vertical strut channel arrangement on the internal skin of container side walls. Corner castings 10 are provided at each of the corners. Floor 11 is provided at the base of the container. Roof 12 is provided at the top of the container. Doors 13 are provided at each short end of the container. Walls 14 are provided at the vertical sides of the container.

Figure 2:
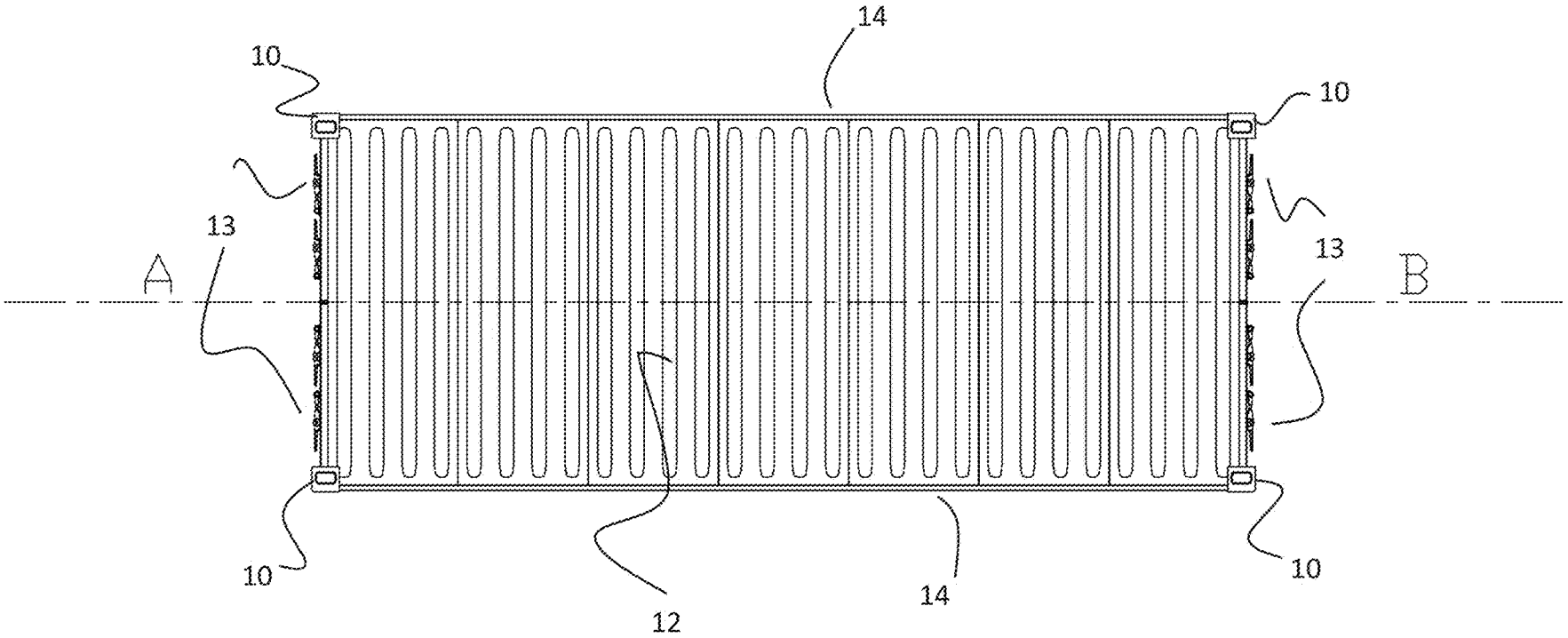
FIG. 2 depicts an external top view of an insulated strut lined shipping container in accordance with the principles described in the present disclosure.
Figures 3, 4:
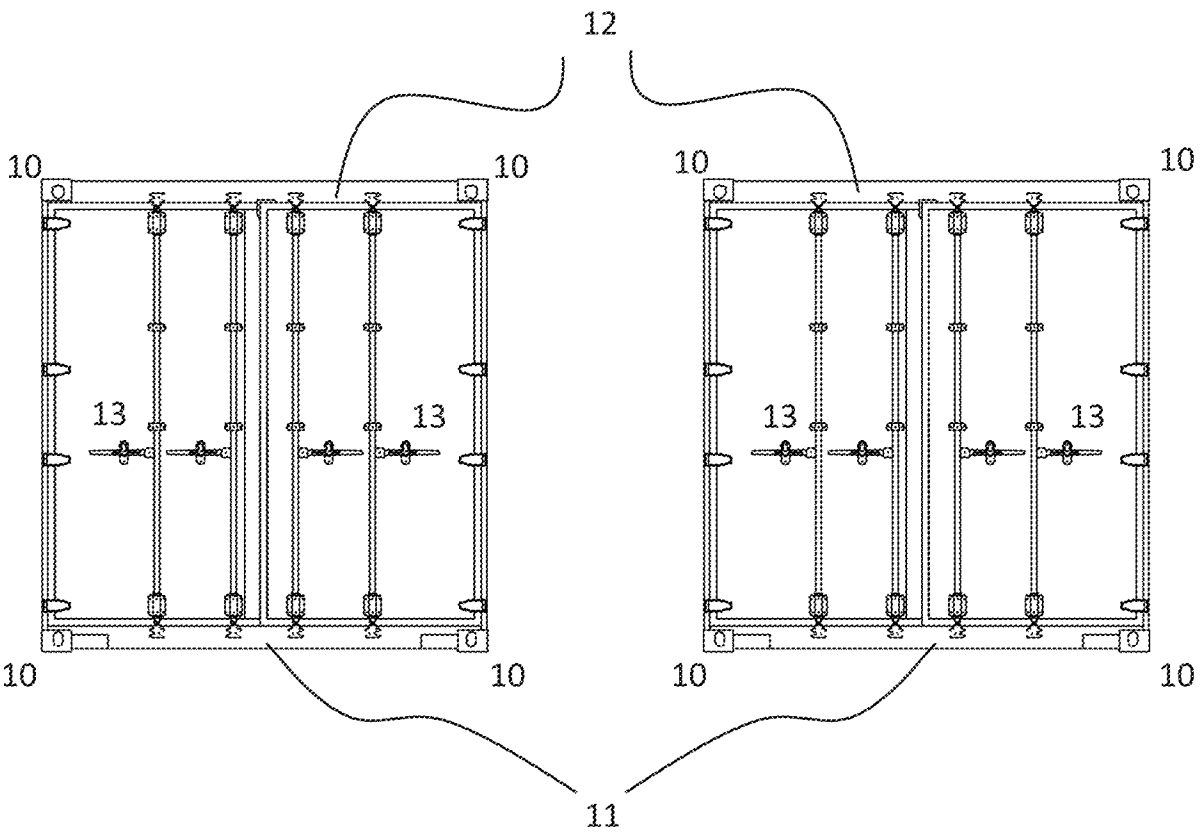
FIG. 3 depicts an external front view of an insulated strut lined shipping container in accordance with the principles described in the present disclosure.
FIG. 4 depicts an external rear view of an insulated strut lined shipping container in accordance with the principles described in the present disclosure.
Figure 7:
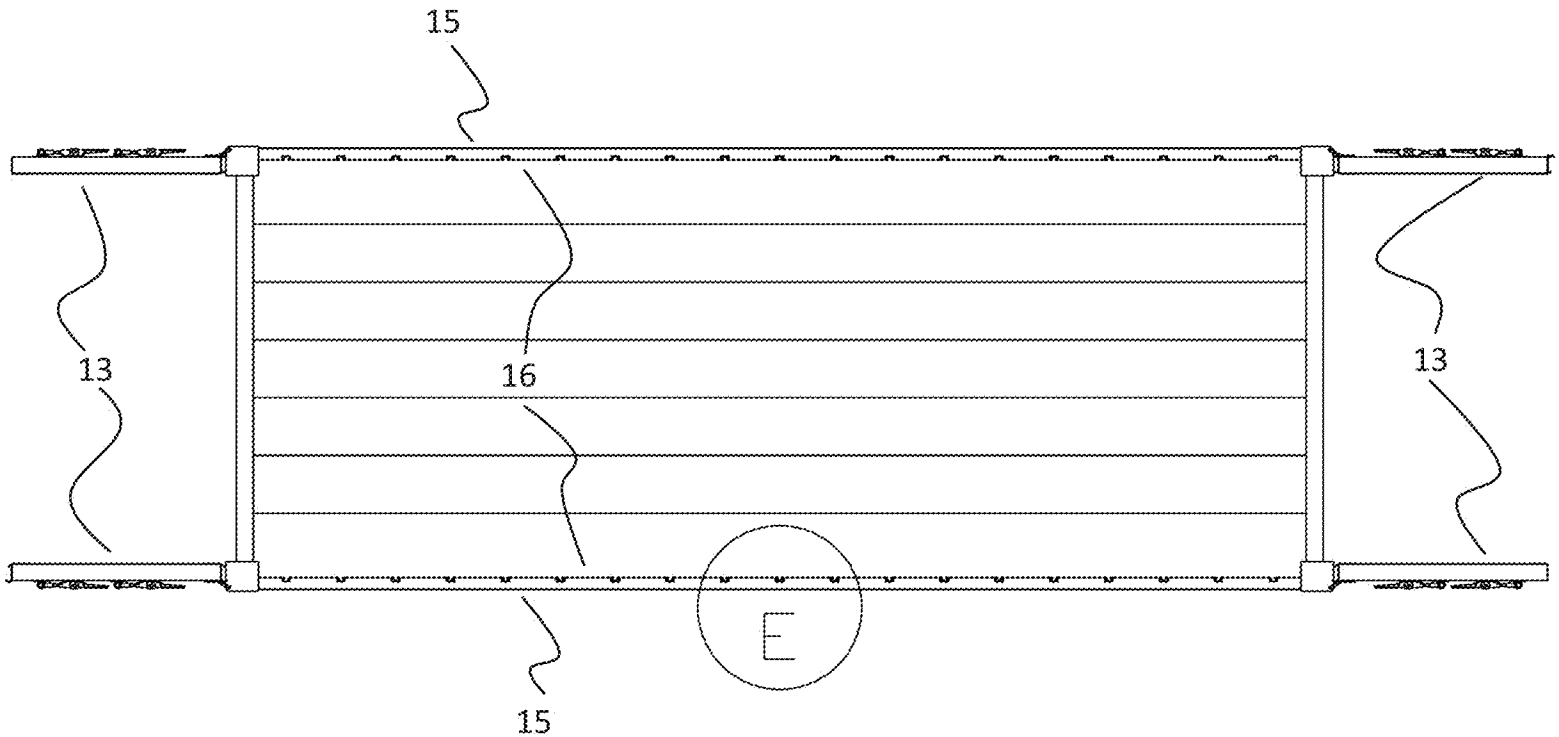
FIG. 7 depicts an internal plan view (section C-D see FIG. 5) of an insulated strut lined shipping container in accordance with the principles described in the present disclosure.

FIG. 2 illustrates a top view of the container, with double doors 13 at both ends closed. FIGS. 3 and 4 illustrate a front and rear view, respectively, which are the same, with double doors 13 at both ends closed. FIG. 7 shows the double doors opened at 90 degrees. The doors may have up to 270 degrees swing.

A typical container door includes various standard fittings, such vertical lock rods, cams, keepers and rubber gaskets to seal against weather and fluids. The cams are welded to the main housing of the container at the top and bottom, and receive the lock rods when closing the doors.

Independent internal panels may be provided together with the container, or may be manufactured and provided separately. If provided with the container, the panels may be shipped within the container alongside any cargo. The panels may have fittings which engage with the same hinges and top and bottom cams as the original double doors, such that these doors can be interchanged conveniently. A variety of panels can be provided, depending on the purpose of the conversion. The panels may include doors and windows, and may have surface decoration to provide an attractive appearance depending on the use. The panels may also comprise materials (other than steel) normally associated with common construction practice.

Figure 5:
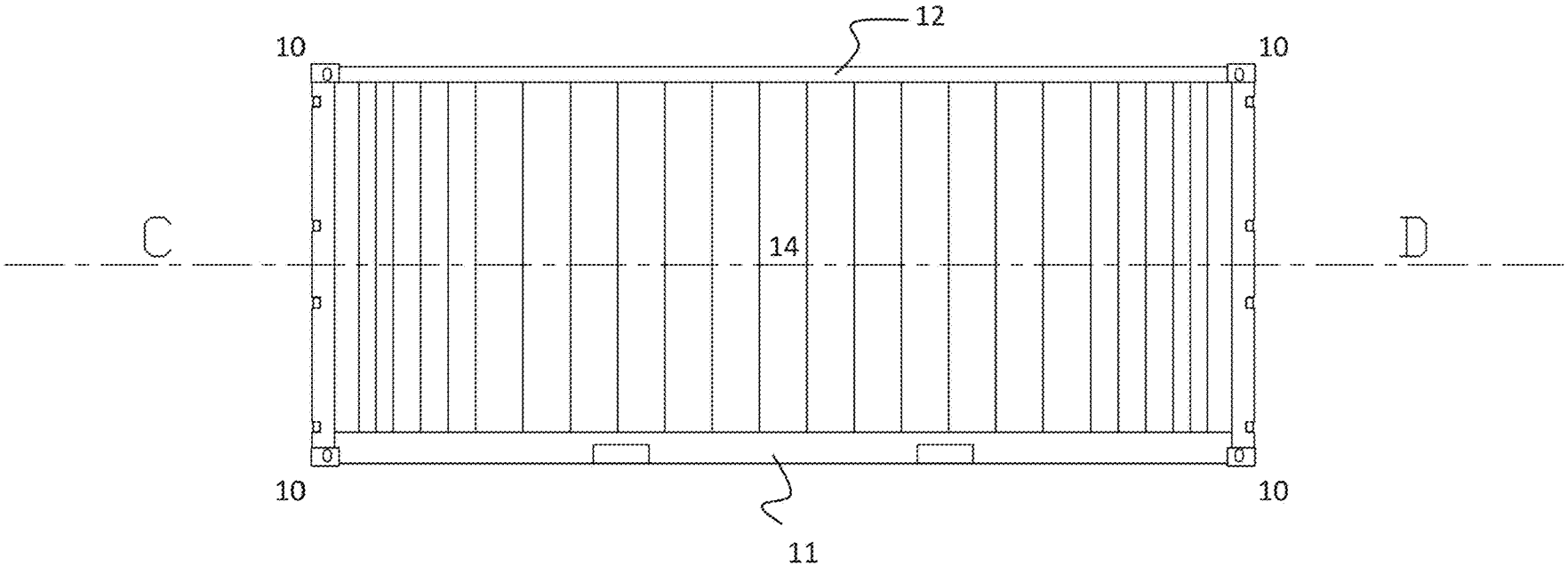
FIG. 5 depicts an external side view of an insulated strut lined shipping container in accordance with the principles described in the present disclosure.

FIG. 5 illustrates a side view showing external skin 15 of side wall 14 with some optional corrugations.

As general-purpose shipping containers only have a thin steel single skin external wall structure, they are bad insulators of both heat and sound. Therefore, the second stage of a container conversion project may include insulation of the container. This is generally achieved by using standard building construction techniques such as the erection of timber or light gauge metal studwork, which is then lined with spray foam, wool or rigid insulation and finally faced with wood, metal, or composite boards.

Figure 8:
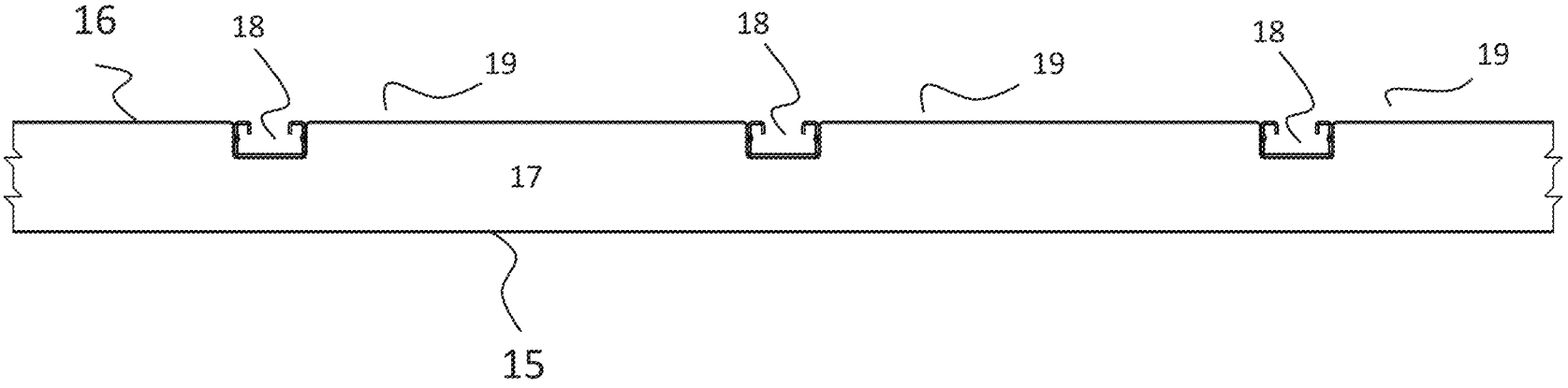
FIG. 8 depicts a flyout view (Detail E see FIG. 7) of a strut lining system example in accordance with the principles described in the present disclosure.
Figure 10:
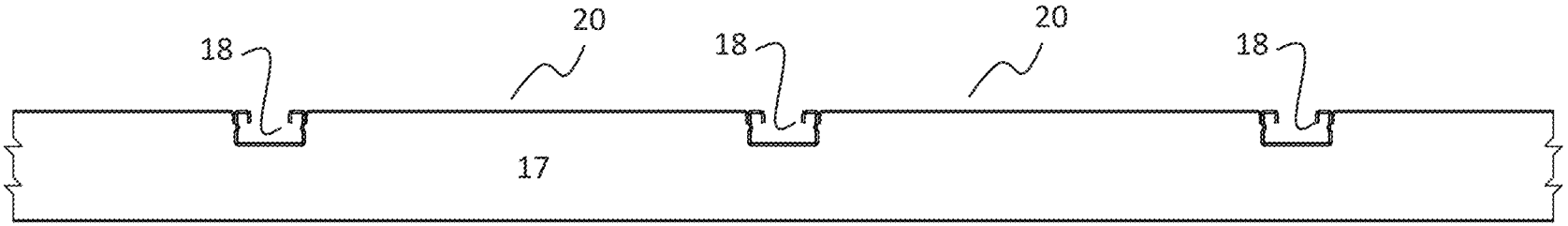
FIG. 10 depicts a flyout view (Detail E see FIG. 7) of a strut lining system example in accordance with the principles described in the present disclosure.
Figure 11:
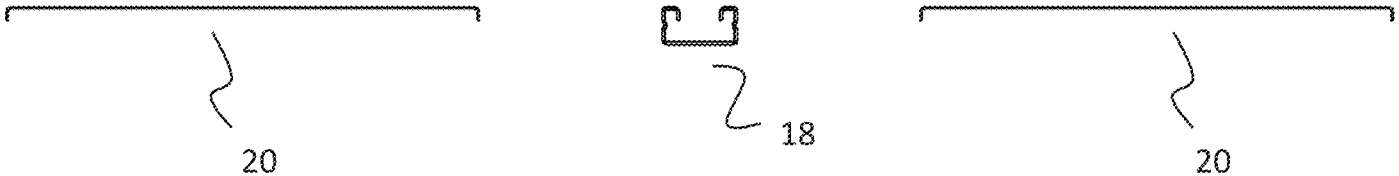
FIG. 11 depicts an exploded view of FIG. 10 identifying the components of a strut lining system example in accordance with the principles described in the present disclosure.
Figure 12:
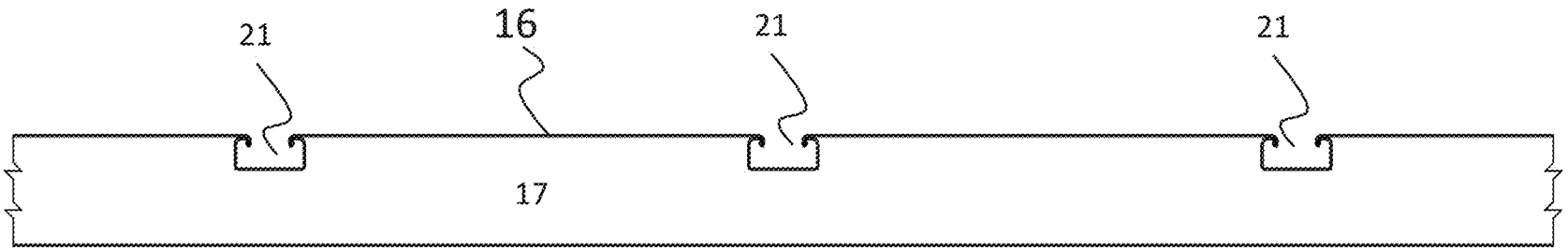
FIG. 12 depicts a flyout view (Detail E see FIG. 7) of a strut lining system example in accordance with the principles described in the present disclosure.
Figure 13:
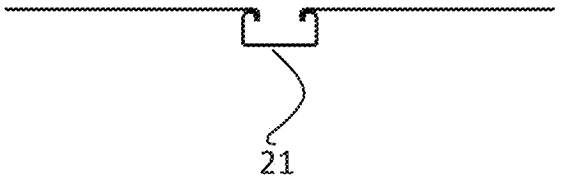
FIG. 13 depicts an exploded view of FIG. 12 identifying the components of a strut lining system example in accordance with the principles described in the present disclosure.

The convertible container presented herein, on the other hand, comprises insulation and side-lining already completed at the factory fabrication stage. FIGS. 8, 10 and 12 are schematic horizontal cross sections showing a double skin wall, including an outer metal skin and an inner metal skin. The main planes of the two skins are parallel, but at least the inner skin has further structural features extending perpendicular to the main plane.

The outer skin is illustrated as a flat panel structure, but may have a slightly corrugated structure to improve strength rigidity. Disadvantage of corrugations include use of more material and causes drag and associated loss in fuel efficiency for road or rail transport.

The outer skin 15 and inner skin 16 together define a cavity 17. The cavity may be filled with an insulating material. A foam insulation may be used, such as polyurethane or other materials known to a person skilled in the art.

In a further embodiment, all six surfaces of the container, including the doors, roof, floor and walls, are insulated. The insulation comprises a double skin metal structure with insulating material in between. All six surfaces will be double lined with an insulation core to create a complete envelope.

Figure 6:
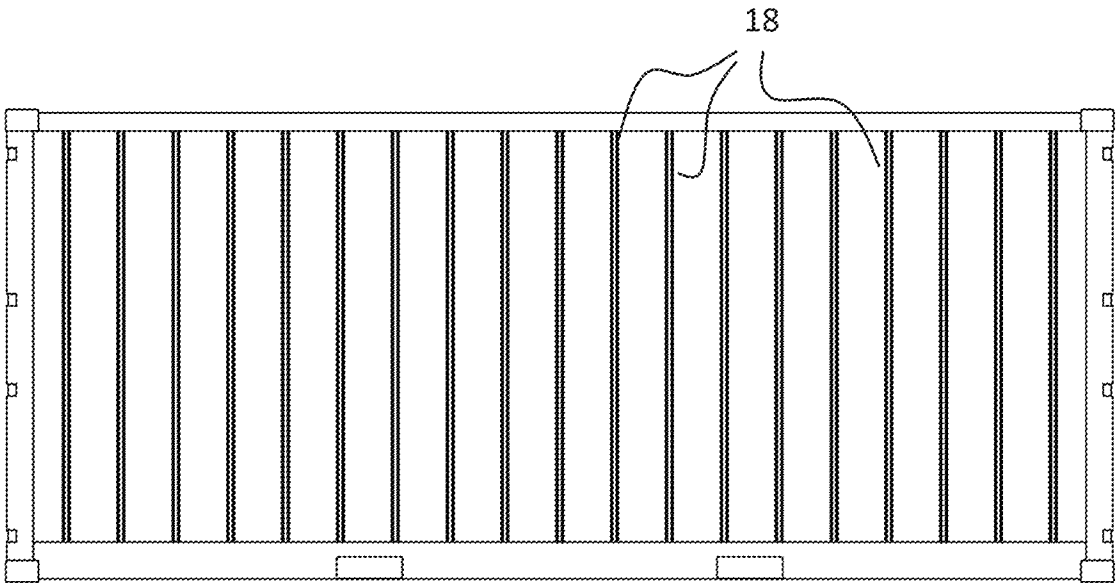
FIG. 6 depicts an internal side view (section A-B see FIG. 2) of an insulated strut lined shipping container in accordance with the principles described in the present disclosure.

FIG. 6 is a cutaway section side view of the container, looking from the inside towards the inside wall. The view shows the strut channels 18, arranged regularly along the inside skin.

FIG. 7 is a cutaway section plan view of the container, looking at it from the top towards the floor. Strut channels 18 are visible, together with the double skin wall. Circle E indicates a detail view, shown in FIGS. 8 to 13 in three different embodiments.

The inner skin 16 comprises a plurality of vertical strut channels 18 and stainless steel panels of various forms. The stainless steel panels may be thin, such as 0.7 mm (0.028").

FIG. 8. FIG. 10, and FIG. 12 illustrate the cross section of Detail E of FIG. 7, with three different embodiments drawn, in all which the inner skin 16 is parallel to outer skin 15.

Figure 9:
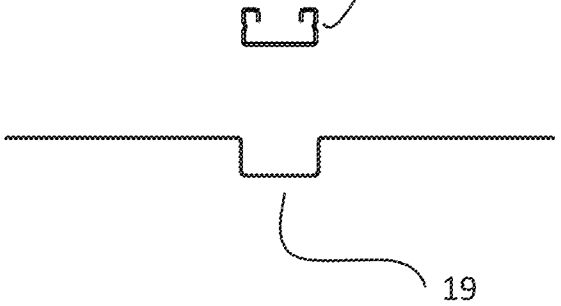
FIG. 9 depicts an exploded view of FIG. 8 identifying the components of a strut lining system example in accordance with the principles described in the present disclosure.

FIG. 8 illustrates a first arrangement of the container wall in particular the inside skin 16. The plurality of strut channels 18 are arranged vertically and parallel to each other, and each strut channel is connected to the next strut channel by way of a stainless steel panel 19 which has vertical recesses sized and located to receive each strut. The stainless steel strut channels 18 can form a snug fit within the panel and may be spot welded in position 19 but may be secured by another method. FIG. 9 shows an exploded view of the internal skin components 18 and 19 prior to assembly together. An advantage of using recessed internal walls is that less welding will be required than in other embodiments, although slightly more material is used on the other hand. Weight is an important aspect to consider as the heavier the container the less cargo it can carry.

As can be seen in FIG. 8, the strut channels do not protrude beyond the main surface of the inner skin assembly 16. The advantage of this feature is that cargo can be stored flush against the skin, and that cargo does not get caught by the strut channels. Another advantage is that recessed strut channel maximises the space available for conversion purposes and is aesthetically more acceptable. The addition of the strut channel in the walls do not reduce the internal volume of a strut lined container compared to any other form of insulated container. The strut channels have inwards folded edges for engaging with standard fittings or coverings and present no sharp profiles endangering health and safety.

FIG. 10 illustrates a second arrangement of the container wall in particular the inside skin 16. The plurality of strut channels 18 are arranged vertically and parallel to each other, and each strut channel is connected to the next strut channel by way welding to an adjacent stainless steel panel 20. The stainless steel panels are illustrated as generally flat panels, but the vertical edges adjoining the strut channels may have small folds to aid stiffness and assist assembly. Additional corrugations can be added to add further structural strength if needed. For example, 7 mm deep pressed corrugations could be used. However, the vertical struts already provide strength and provide an effect similar to corrugations.

FIG. 12 illustrates a third arrangement of the container wall in particular the inside skin 16 whereby the strut channel form 21 is pre-rolled into stainless steel or extruded into aluminium panels and negates the need for separate strut channel and intermediate panels. This arrangement reduces both the volume of parts and welding required but would be more difficult to manufacture. Aluminium is a preferred material as it is easier to form into difficult shapes by die extrusion process. Although the preferred material is described as aluminium, this should be interpreted as possibly being an aluminium alloy because that is stronger than pure aluminium. Aluminium is not as strong as stainless steel but is a much lighter material, so thicker material aluminium could be used to achieve similar structural performance as stainless steel.

Although stainless steel is indicated as a preferred material for the panels and outer skin, the skilled person will understand that a variety of suitable metals can be used. The material for the outer skin is preferably stainless steel because of the strength, while the material of the inside skin is preferably aluminium in the embodiment of FIG. 12 to allow easier rolling or extrusion. In the embodiments of FIGS. 8 and 10, stainless steel or aluminium may be used, whereby an advantage of stainless steel is the higher strength mentioned before. Both stainless steel and aluminium have good corrosion resistance. The inside skin is preferably extruded from an aluminium billet, rather than rolled (even though that is possible), while the outside skin is rolled.

The strut channels 18 may be shallow light duty stainless steel strut channels, in a particular example with dimensions 1"⅝" (41.28 mm)×13⁄16" (20.64 mm)×16 gauge (1.52 mm), but other dimensions may be used as well. The struts may be spaced apart at 300 mm intervals, measured from the centre of one strut channel to the centre of the next strut channel. This not only maintains the structural rigidity of the thin side-lining assembly but also allows easy installation and attachment of structures, furniture or prefabricated modules using international standard fittings. The strut channel may also act as ductwork for mechanical or electrical services. The struts as such are known and used in buildings for attaching furniture or structures to. The expressions 'struts' and 'strut channels' are used interchangeably herein and denote the same element. Some struts are referred to under the Unistrut™ brand name, while being sold under many different brand names.

The struts may be in the form of plain channel, without pre-drilled holes or slots that channel spring nuts can be inserted into which then supports the fixing of standard fittings such as strut fixings, cantilever arms or pipe clamps. An advantage is that standard fittings can be used without requiring welding or cutting into the metal container when converting to a different purpose.

The strut channels may also comprise pre-drilled holes or slots for receiving standard fixings. If slotted channel struts are used, a cavity is preferably provided between the back wall of the strut and the recess such that any standard fixings can be inserted into the holes or slots.

As illustrated in FIG. 6, the strut channels may extend over the full internal height of the wall in the preferred embodiment, or the struts may extend over part of the height. A lower part of the inner wall may be covered in a continuous material without struts for robustness when loading cargo with a forklift.

Figure 14:
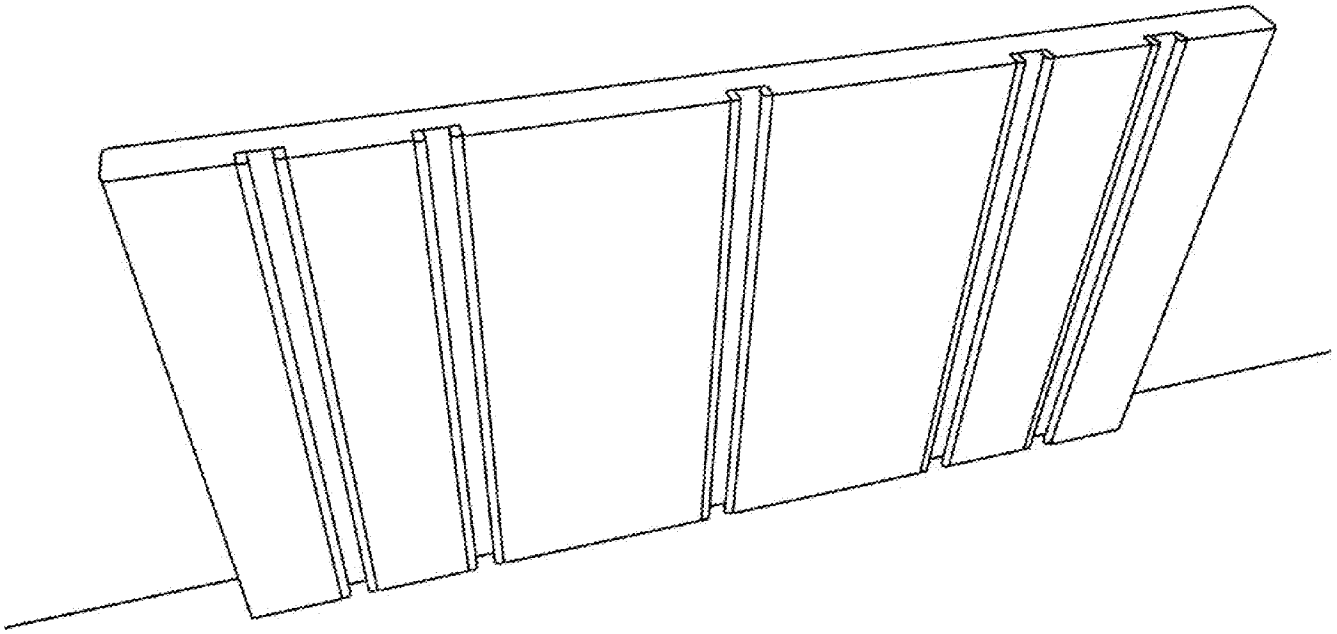
FIG. 14 is a photo of a strut lining system including struts.

FIG. 14 is a photo of a strut lining system including struts.

As the external and internal dimensions of shipping containers are regulated by ISO standards and the new vertical strut channel features are installed at set 300 mm centres, this allows for efficient modular design of internal fit out furniture and modular structures which can be then batch or mass-produced increasing efficiencies, reducing cost and minimising environmental impact.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A container suitable for intermodal freight transport and for conversion for use other than intermodal freight transport, the container comprising:

walls, at least one of the walls comprising:

an outer skin; and an inner skin, wherein the inner skin comprises a plurality of parallel vertical strut channels;

wherein the plurality of parallel vertical strut channels comprise inwards folded edges;

wherein the plurality of strut channels are connected to each other by a plurality of panels, and wherein the plurality of strut channels are formed with the plurality of panels to form said inner skin.

2. The container according to claim 1, wherein the strut channels are spaced apart from each other by a distance of substantially 300 mm.

3. The container according to claim 1, wherein the strut channels are received within the inner skin of the walls, such that a main surface of the inner skin is flush.

4. The container according to claim 1, wherein the strut channels are configured for positioning, attaching, and securing of prefabricated structures, furniture, and modules.

5. The container according to claim 1, wherein the strut channels are configured for routing of mechanical and/or electrical services.

6. The container according to claim 1, wherein the strut channels are configured to receive fixings, channel nuts, cantilever arms, or pipe clamps.

7. The container according to claim 1, wherein the strut channels comprise plain channels or slotted channels.

8. The container according to claim 1, wherein the outer skin and the inner skin of the walls define a cavity.

9. The container according to claim 8, wherein the cavity comprises an insulating material, and wherein the insulating material comprises polyurethane foam.

10. The container according to claim 1, wherein the container comprises an insulating layer in a floor, a roof, the walls, and external doors.

11. The container according to claim 1, further comprising two first surfaces of the container opposite to each other and two second surfaces of the container opposite to each other, wherein an area of the two first surfaces is smaller than an area of the two second surfaces, and external doors are disposed at the two first surfaces of the container.

12. An assembly comprising the container according to claim 11, wherein the external doors are replaced with one or more panels when converting the container for use other than intermodal freight transport.

13. The assembly according to claim 12, wherein the one or more panels comprises one or more of a door, a window, and surface decoration.

14. The container according to claim 1, wherein one or more of the inner skin, the outer skin, and the strut channels comprise a metal, stainless steel, aluminium, or aluminium alloy.

15. A method of manufacturing the container of claim 1, the method comprising: forming said outer skin, and forming said inner skin comprising the plurality of parallel vertical strut channels.

16. The method according to claim 15, wherein the forming the inner skin comprises extruding a piece of aluminium into the inner skin comprising the plurality of vertical strut channels and a plurality of panels connecting the plurality of vertical strut channels.

* * * * *